US010677430B2

(12) United States Patent
Fujisawa et al.

(10) Patent No.: US 10,677,430 B2
(45) Date of Patent: Jun. 9, 2020

(54) DRIVING DEVICE AND LIGHTING DEVICE

(71) Applicant: MINEBEA MITSUMI INC., Kitasaku-gun, Nagano (JP)

(72) Inventors: Shinichi Fujisawa, Akiruno (JP); Hidenori Fuma, Tokorozawa (JP)

(73) Assignee: MINEBEA MITSUMI INC., Nagano (JP)

( * ) Notice: Subject to any disclaimer, the term of this patent is extended or adjusted under 35 U.S.C. 154(b) by 213 days.

(21) Appl. No.: 15/490,410

(22) Filed: Apr. 18, 2017

(65) Prior Publication Data

US 2017/0307193 A1 Oct. 26, 2017

(30) Foreign Application Priority Data

Apr. 22, 2016 (JP) ..... 2016-086352

(51) Int. Cl.

| | |
|---|---|
| ***F21V 21/14*** | (2006.01) |
| ***F21V 21/30*** | (2006.01) |
| ***F21V 29/74*** | (2015.01) |
| ***F21V 23/00*** | (2015.01) |
| ***F21V 29/76*** | (2015.01) |
| ***F21S 8/02*** | (2006.01) |

(Continued)

(52) U.S. Cl.

CPC ..... *F21V 21/14* (2013.01); *F21S 8/026* (2013.01); *F21V 7/04* (2013.01); *F21V 21/30* (2013.01); *F21V 23/001* (2013.01); *F21V 23/002* (2013.01); *F21V 29/74* (2015.01); *F21V 29/76* (2015.01); *F21Y 2115/10* (2016.08)

(58) Field of Classification Search

CPC ..... F21V 21/14; F21V 29/74; F21V 29/76; F21V 21/30; F21V 23/001; F21V 23/002; F21S 8/026

See application file for complete search history.

(56) References Cited

U.S. PATENT DOCUMENTS

| | | | | |
|---|---|---|---|---|
| 3,660,651 | A | 5/1972 | Miles, Jr. | |
| 7,311,422 | B1 * | 12/2007 | Chen | F21S 8/02 362/269 |

(Continued)

FOREIGN PATENT DOCUMENTS

| | | | |
|---|---|---|---|
| EP | 0189742 | A1 | 8/1986 |
| JP | H05-87740 | U | 11/1993 |
| JP | 2012-048996 | A | 3/2012 |

OTHER PUBLICATIONS

Feb. 27, 2018 Office Action issued in Japanese Patent Application No. 2016-086352.

(Continued)

*Primary Examiner* — Jong-Suk (James) Lee
*Assistant Examiner* — Christopher E Dunay
(74) *Attorney, Agent, or Firm* — Oliff PLC

(57) ABSTRACT

A driving device of an embodiment includes a first rotational unit and a holding unit. The first rotational unit is disposed with an object to be operated on one surface side intersecting with a first rotating shaft, and rotationally moves around the first rotating shaft with the object to be operated. The holding unit is disposed on another surface side of the first rotational unit, rotates with the first rotational unit, and holds a cable for supplying power to the object to be operated at a position away from the first rotational unit toward the other surface side, while placing the cable along the first rotating shaft.

7 Claims, 16 Drawing Sheets

(51) Int. Cl.
*F21V 7/04* (2006.01)
*F21Y 115/10* (2016.01)

(56) References Cited

U.S. PATENT DOCUMENTS

| | | | | |
|---|---|---|---|---|
| 2008/0304269 | A1* | 12/2008 | Pickard | F21V 21/048 362/365 |
| 2009/0139084 | A1* | 6/2009 | Franklin | G02B 6/4488 29/825 |
| 2009/0268474 | A1* | 10/2009 | Ward | F21S 8/02 362/364 |
| 2010/0149822 | A1* | 6/2010 | Cogliano | F21S 8/02 362/365 |
| 2015/0233537 | A1* | 8/2015 | Athalye | F21S 8/026 362/147 |
| 2015/0241039 | A1* | 8/2015 | Fryzek | F21V 21/14 362/419 |
| 2015/0276190 | A1* | 10/2015 | Devlin | F21V 21/15 362/362 |
| 2016/0008905 | A1 | 1/2016 | Izawa et al. | |
| 2017/0038046 | A1* | 2/2017 | Bardot | F21V 3/00 |

OTHER PUBLICATIONS

Jun. 26, 2017 Extended Search Report issued in European Patent Application No. 17167191.0.

* cited by examiner

DRIVING DEVICE AND LIGHTING DEVICE

CROSS-REFERENCE TO RELATED APPLICATION(S)

The present application claims priority to and incorporates by reference the entire contents of Japanese Patent Application No. 2016-086352 filed in Japan on Apr. 22, 2016.

BACKGROUND OF THE INVENTION

1. Field of the Invention

The present invention relates to a driving device and a lighting device.

2. Description of the Related Art

Conventionally, various lighting devices such as a downlight (universal) have been provided. For example, a lighting device used as the downlight may be embedded in a ceiling. Furthermore, a technology of fixing an electric wire (cable) that is drawn out from a lighting device (driving device) without using an extra part such as a metal fitting has been known (Japanese Laid-open Patent Publication No. 2012-048996).

However, in the above-described conventional technology, when the irradiation direction of the lighting device (driving device) can be changed to any direction, it is difficult to prevent entanglement of the cable due to the rotational movement of the light device. For example, when the lighting device can be rotationally moved in the horizontal direction, and the irradiation direction of the lighting device can be changed to any direction, there is a possibility that the cable is entangled due to the rotational movement of the lighting device.

The present invention is made for the foregoing reasons, and an objective of the present invention is to provide a driving device and a lighting device that can prevent a cable from being entangled due to rotational movement.

SUMMARY OF THE INVENTION

It is an object of the present invention to at least partially solve the problems in the conventional technology.

A driving device according to an embodiment includes a first rotational unit and a holding unit. The first rotational unit is disposed with an object to be operated on one surface side intersecting with a first rotating shaft, and rotationally moves around the first rotating shaft with the object to be operated. The holding unit is disposed on another surface side of the first rotational unit, and rotationally moves with the first rotational unit and holding a cable for supplying power to the object to be operated at a position away from the first rotational unit toward the other surface side, while placing the cable along the first rotating shaft.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

In the following embodiment, a lighting device 1 will be described as an example of a driving device, with reference to the accompanying drawings. For example, the lighting device 1 includes a light source 100 as an object to be operated. It should be noted that the usage of the driving device is not limited to the lighting device 1 according to the embodiment that will be described below. The driving device is not limited to the lighting device 1, and may be used as any device corresponding to an object, as long as the direction of the object to be operated can be changed in a desirable direction. The drawings are schematic, and it should also be noted that the dimensional relation of the components and the ratios of the components, for example, may differ from the actual ones. It should further be noted that the respective drawings may include portions that have different dimensional relations and ratios.

EMBODIMENT

Figure 1:
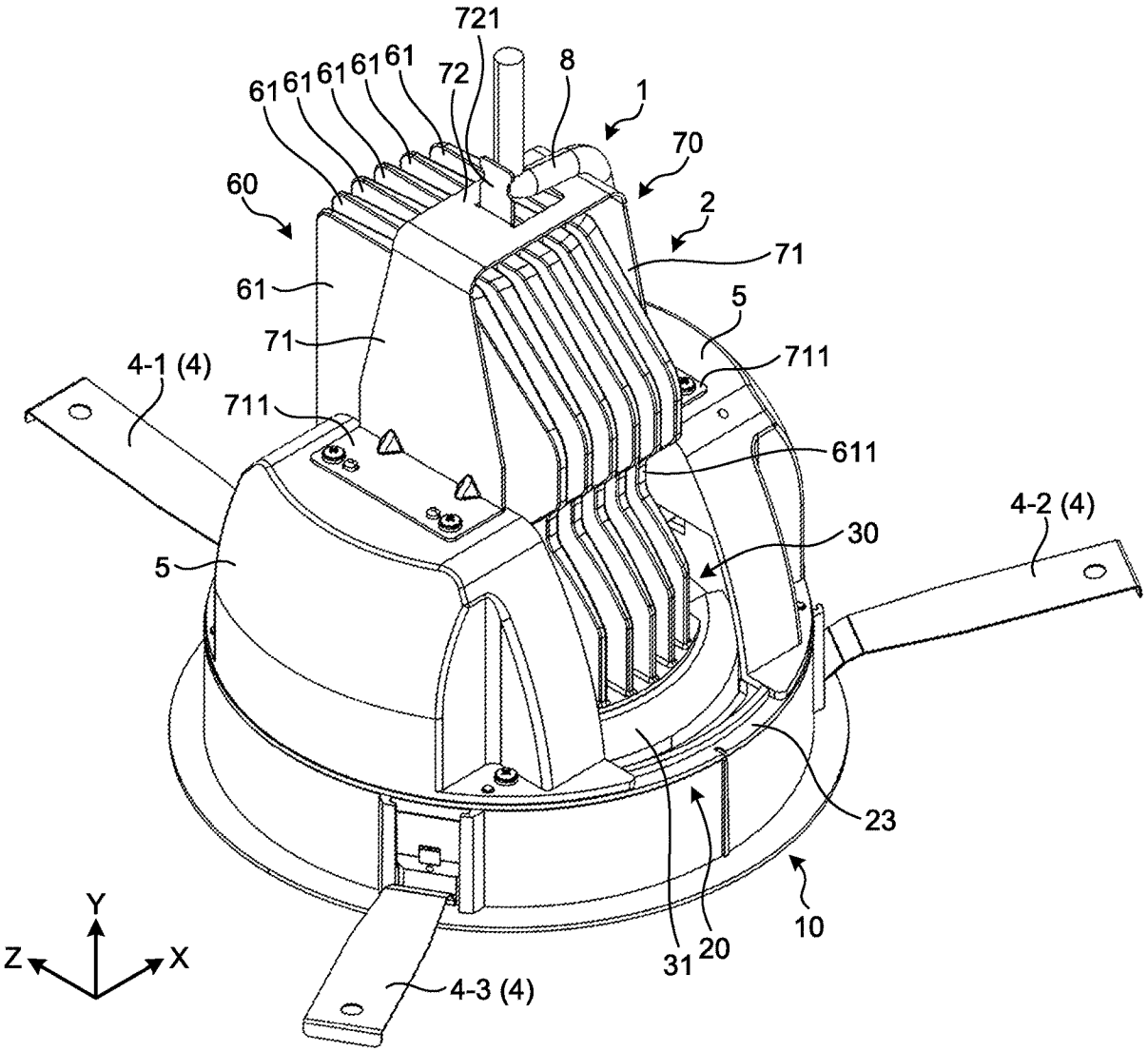
FIG. 1 is a perspective view illustrating a lighting device according to an embodiment.
Figure 2:
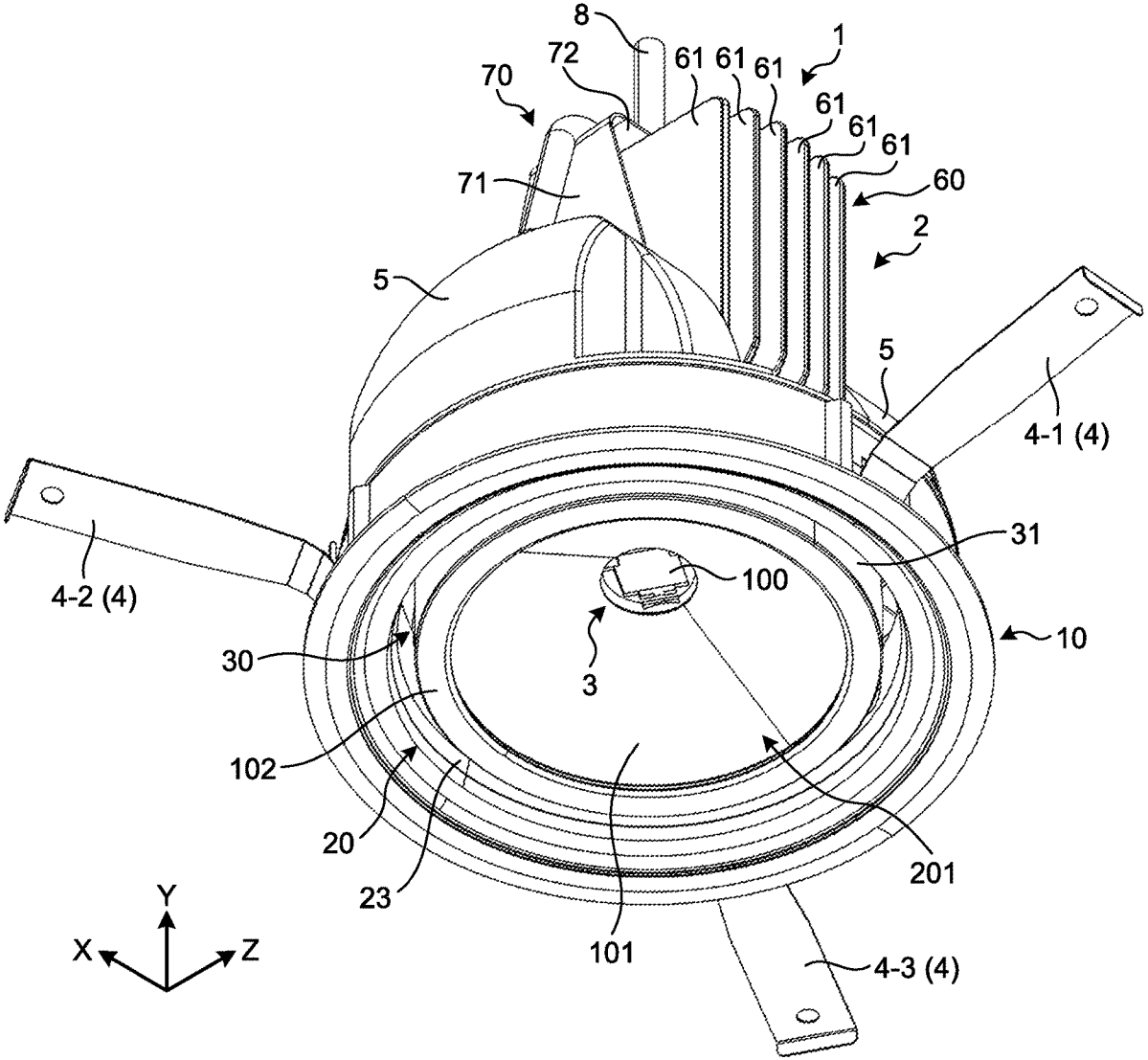
FIG. 2 is a perspective view illustrating the lighting device according to the embodiment.
Figure 3:
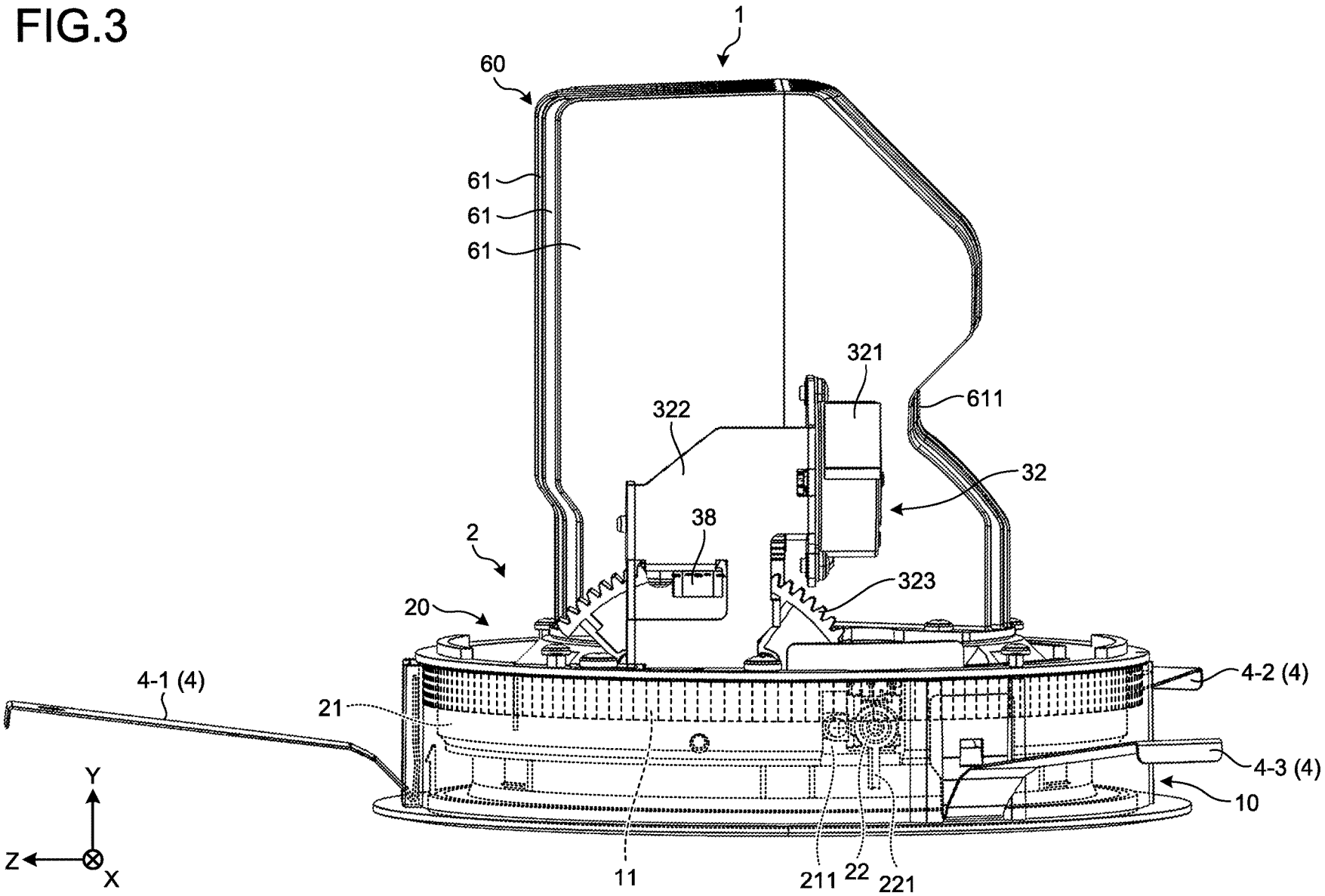
FIG. 3 is a side view (partial perspective view) illustrating the lighting device according to the embodiment.

First, an overview of the configuration of a lighting device 1 will be described with reference to FIG. 1 to FIG. 3. FIG. 1 and FIG. 2 are perspective views each illustrating a lighting device according to an embodiment. More specifically, FIG. 1 is a perspective view of the lighting device 1, when viewed from the opposite side of a light source unit 3. Furthermore, FIG. 2 is a perspective view of the lighting device 1, when viewed from the light source unit 3 side. In FIG. 2, a lens (optical member) is omitted so as to illustrate a light source 100 of the light source unit 3. FIG. 3 is a side view (partial perspective view) illustrating the lighting device according to the embodiment. More specifically, FIG. 3 is a diagram of the lighting device 1, when seen through a frame body 10.

In the following, a Y axis indicates a direction along a first rotating shaft (see the rotating shaft PV 1 in FIG. 16) that is a rotating shaft of a first rotational unit 20, which will be described below. An X axis and a Z axis indicate axes that are orthogonal to each other in the plane perpendicular to the Y axis. For example, the X axis is a direction along a second rotating shaft that is a rotating shaft of a second rotational unit 30 at a position (initial position) when the lighting device 1 is to be mounted. The following explains the configuration of the lighting device 1 based on the initial position state of the lighting device 1, except where change in direction such as an inclination of the lighting device 1 is referred.

The lighting device 1 includes the frame body 10, an angle adjustment device 2, the light source unit 3, a plurality of fixtures 4, a pair of covers 5 as a cover unit, a heat sink 60 as a heat radiation unit, a holding unit 70, and a cable 8. The lighting device 1 may also include a power source unit 9 (see FIG. 15). The light source unit 3 is an object to be operated the direction of which is to be changed. For example, the light source unit 3 includes the light source 100 such as a light emitting diode (LED), a reflection plate 101, and a holding member 102 for holding the lens described above. The light source 100 may also be a chip on board (COB) and the like. The light source unit 3 is mounted on the angle adjustment device 2, and the details will be described later. In the present embodiment, three fixtures 4-1, 4-2, and 4-3 are provided. When the fixtures 4-1, 4-2, and 4-3 need not be distinguished from each other, they are referred to as the fixture 4.

Figure 4:
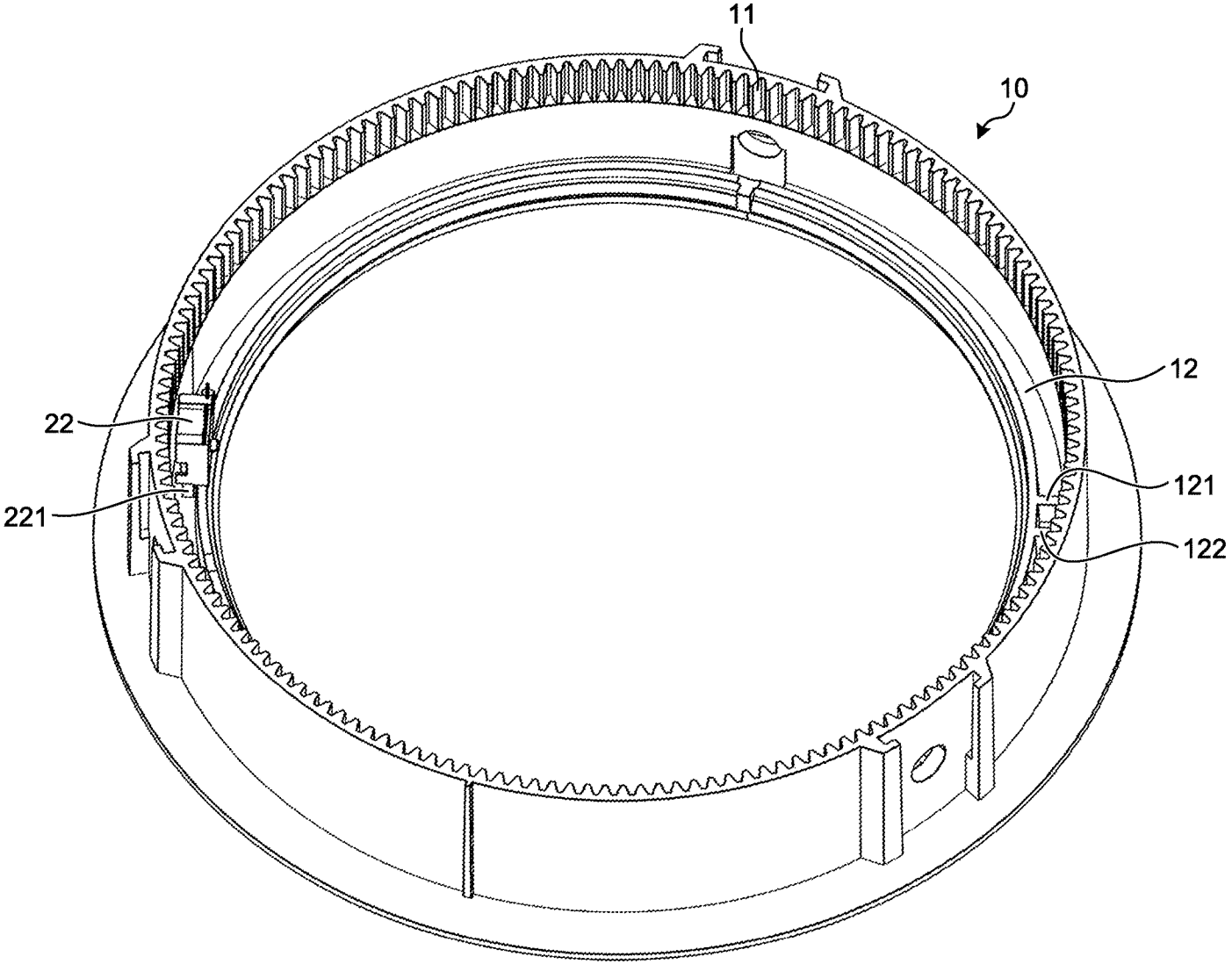
FIG. 4 is a perspective view illustrating a frame body according to the embodiment.

The frame body 10 and the angle adjustment device 2 that are configurations on the rotational movement of the lighting device 1 will now be described. As illustrated in FIG. 4, the frame body 10 has a cylindrical shape (sectional surface has an annular shape). FIG. 4 is a perspective view illustrating a frame body according to the embodiment. For example, the frame body 10 is formed of resin and the like. For example, the frame body 10 is embedded in an embedding hole that is provided on a ceiling surface (see a ceiling CL in FIG. 15) and the like, and the details will be described later. In the following, the positive Y axis direction is the upward direction, the negative Y axis direction is the downward direction, and a direction perpendicular to the Y axis is the horizontal direction. In this case, for example, the negative Y axis direction is the gravity direction, and a plane perpendicular to the Y axis is a horizontal plane.

Internal teeth 11 are formed on the inner peripheral surface of the frame body 10. More specifically, the internal teeth 11 are formed along the inner periphery of an end (hereinafter, also referred to as an "upper end") of the frame body 10 in the shaft direction. Furthermore, an inner flange unit 12 is formed on the inner peripheral surface of the frame body 10. More specifically, the inner flange unit 12 that extends toward the center from the inner peripheral surface is formed on the other end (hereinafter, also referred to as a "lower end") of the frame body 10 in the shaft direction. A pair of projection units 121 and 122 that project to the upper end side are formed on the inner flange unit 12. In the lighting device 1, the projection units 121 and 122 of the frame body 10, and a limit switch 22, which will be described below, restrict the rotational movement of the angle adjustment device 2 around the shaft of the frame body 10, and the details will be described later. In FIG. 4, the limit switch 22 is illustrated to indicate the positional relation with the projection units 121 and 122. However, the limit switch 22 is mounted on the first rotational unit 20, which will be described below.

The angle adjustment device 2 includes the first rotational unit 20, the second rotational unit 30, and a spring member 40, which will be described below.

Figure 5:
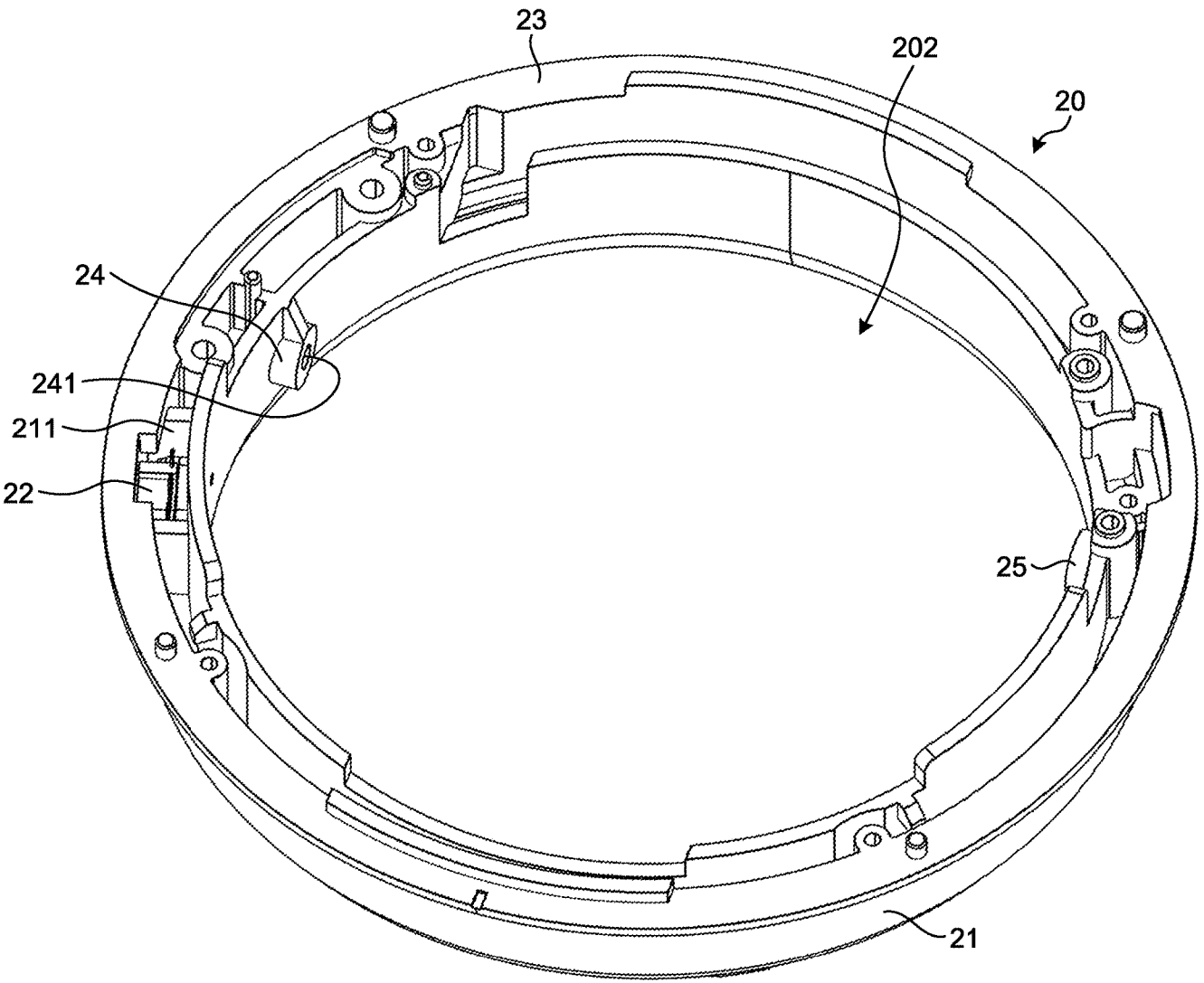
FIG. 5 is a perspective view illustrating a first rotational unit according to the embodiment.
Figure 6:
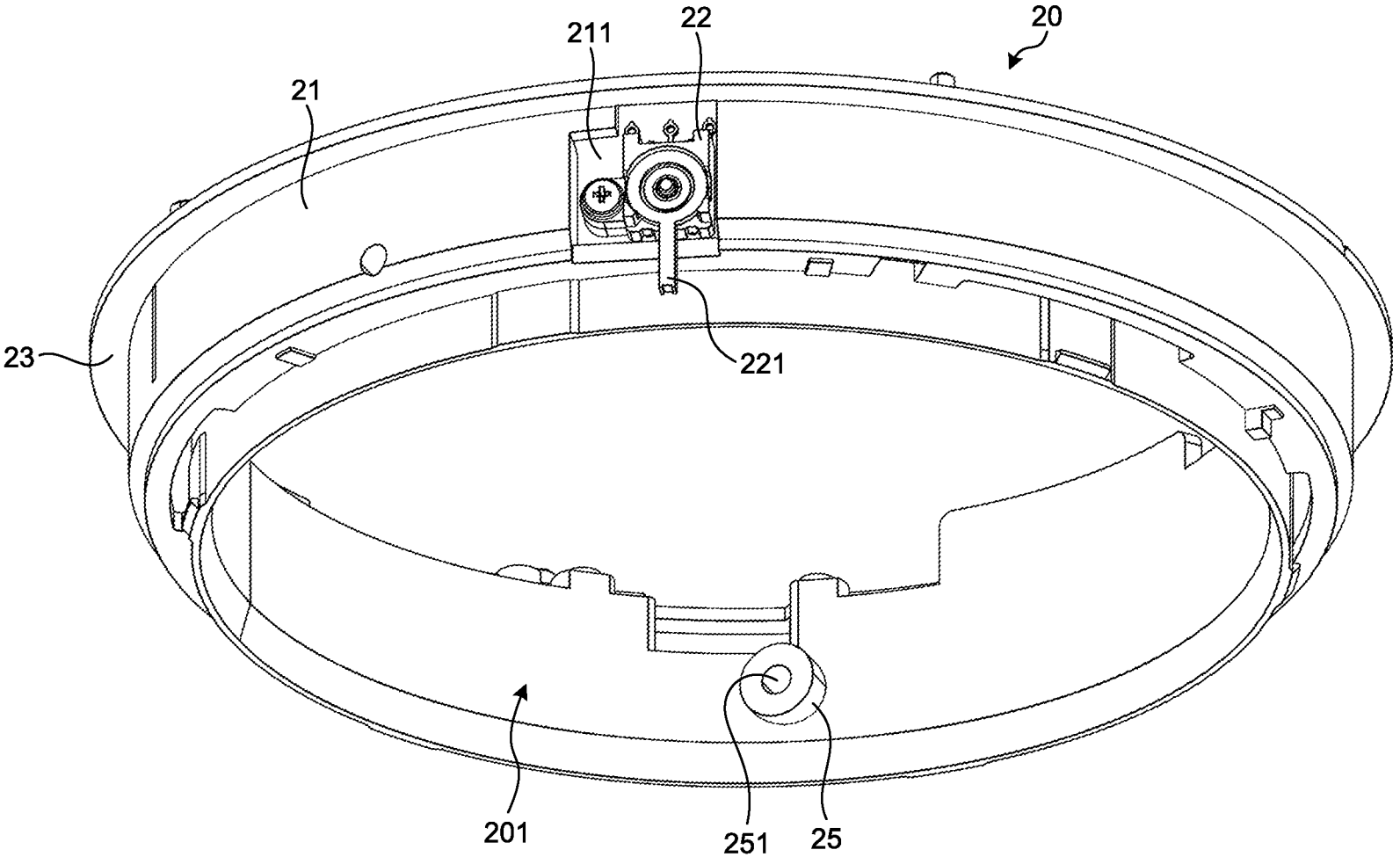
FIG. 6 is a perspective view illustrating the first rotational unit according to the embodiment.

As illustrated in FIG. 5 and FIG. 6, the first rotational unit 20 has a cylindrical shape. FIG. 5 and FIG. 6 are perspective views each illustrating a first rotational unit according to the embodiment. As illustrated in FIG. 2, in the first rotational unit 20, the light source 100 is disposed so as to face a surface 201 side that intersects with the first rotating shaft, and the first rotational unit 20 rotationally moves around the first rotating shaft with the light source 100. Furthermore, as illustrated in FIG. 5, an opening surface at an outer flange unit 23 side is another surface 202. In other words, as illustrated in FIG. 6, the surface 201 is an opening surface at the side opposite to the outer flange unit 23.

For example, the first rotational unit 20 is formed of resin or the like. The first rotational unit 20 includes a base unit 21. An outer flange unit 23 that extends toward the outside from the outer peripheral surface is formed on an end (hereinafter, also referred to as an "upper end") of the base unit 21 in the shaft direction. The outer flange unit 23 of the first rotational unit 20 is slidably supported by the upper end surface of the frame body 10. In this manner, the frame body 10 rotatably supports the first rotational unit 20 in the horizontal direction. Furthermore, bearing units 24 and 25 that rotatably support the second rotational unit 30 in the vertical direction are provided on the inner peripheral surface of the base unit 21 of the first rotational unit 20, and the details will be described later.

The limit switch 22 is disposed in a concave 211 that is formed on a part of the outer periphery of the base unit 21. Furthermore, the pair of projection units 121 and 122 are provided on the inner flange unit 12 of the frame body 10 as described above. Consequently, the projection units 121 and 122 of the inner flange unit 12 restrict the rotation of the first rotational unit 20 in the horizontal direction that is caused by a first driving unit 27, which will be described below. A lever 221 is provided on the limit switch 22. In other words, the angle adjustment device 2 electrically detects a rotating operation of the first rotational unit 20 in the horizontal direction, using the limit switch 22 that is disposed in the concave 211 of the base unit 21 as well as the projection units 121 and 122 of the inner flange unit 12.

The angle adjustment device 2 detects the limit of the rotation angle that has been set, when the lever 221 of the limit switch 22 is rotationally moved by one of the projection units 121 and 122 of the inner flange unit 12. The limit is used to control the motor, such as to stop operating a first motor 271, which will be described below. In the present embodiment, the rotation angle of the first rotational unit 20 in the horizontal direction is in a range substantially 360 degrees, by the limit switch 22 as well as the projection units 121 and 122 of the inner flange unit 12.

Figure 7:
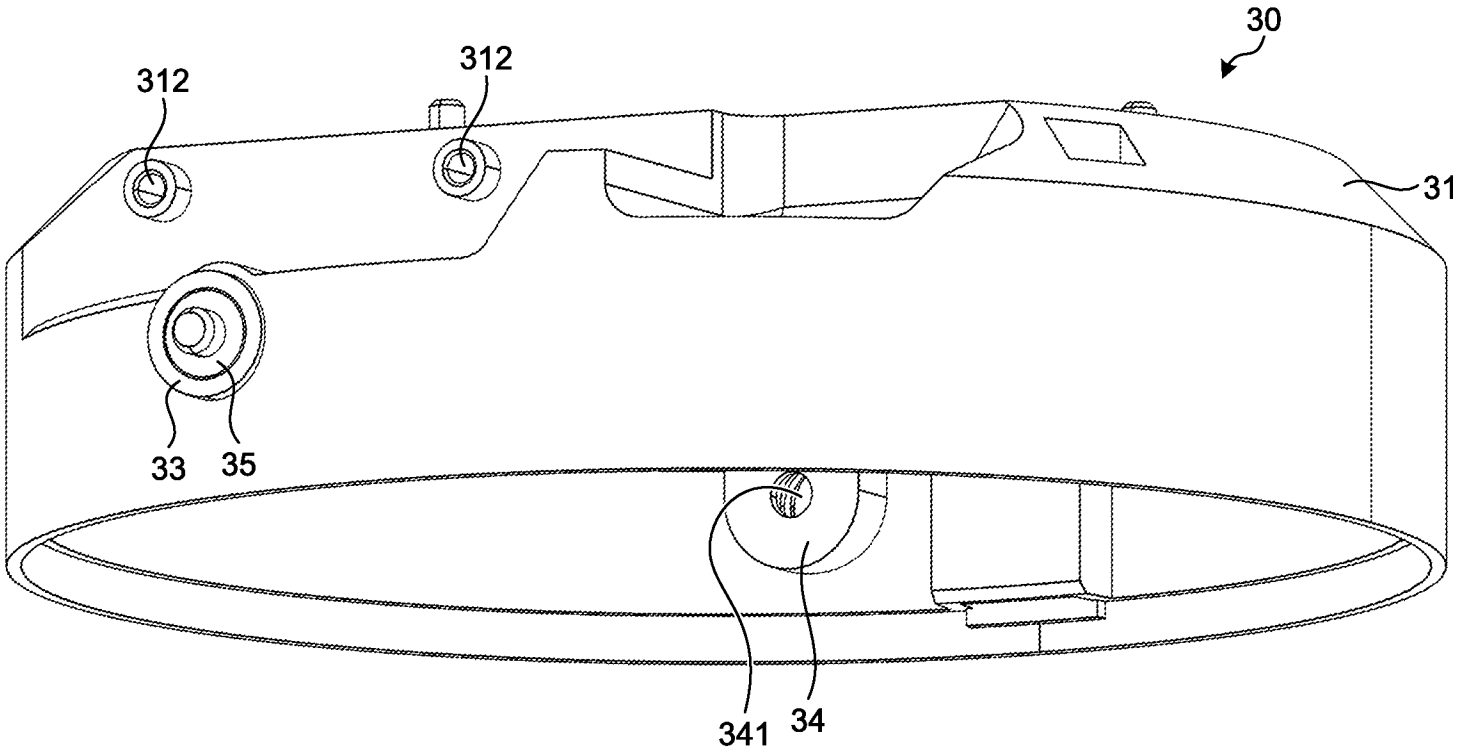
FIG. 7 is a perspective view illustrating a second rotational unit according to the embodiment.
Figure 8:
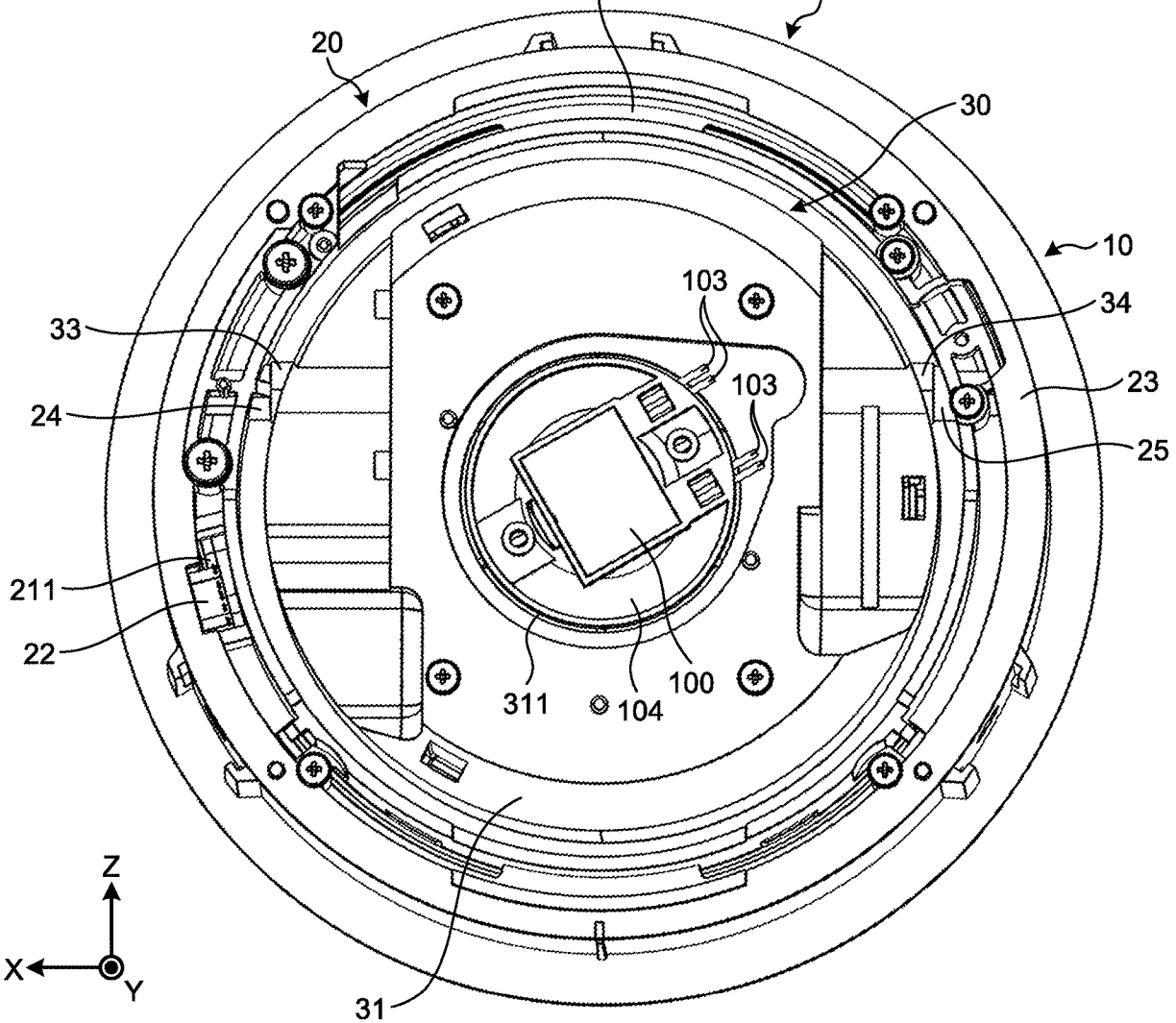
FIG. 8 is a plan view illustrating the lighting device according to the embodiment.

The first rotational unit 20 supports the second rotational unit 30, and the second rotational unit 30 rotationally moves around the second rotating shaft being different from the first rotating shaft. As illustrated in FIG. 7 and FIG. 8, the second rotational unit 30 has a hollow columnar shape (sectional surface has an annular shape), one side of which is opened. FIG. 7 is a perspective view illustrating a second rotational unit according to the embodiment. FIG. 8 is a plan view illustrating the lighting device according to the embodiment. More specifically, FIG. 8 is a plan view excluding the cover 5, the heat sink 60, and the like of the lighting device 1, to illustrate the second rotational unit 30. For example, the second rotational unit 30 is formed of resin and the like. The second rotational unit 30 includes a base unit 31 one surface of which in the shaft direction is formed with a through hole 311. A holding member 104 for holding the light source 100 to which power is supplied from a cable 103 and the like is disposed in the through hole 311 of the base unit 31. For example, the cable 103 is integrated into the cable 8 and is drawn out from the lighting device 1, and the details will be described later. Furthermore, a fixing hole 312 for fixing a second driving unit 32, which will be described below, is provided on a part of the outer peripheral surface of the base unit 31, and the details will be described later.

Furthermore, a pair of pivotally supporting parts 33 and 34 are provided on the outer peripheral surface of the second rotational unit 30. The pair of pivotally supporting parts 33 and 34 are disposed on a single straight line (same straight line) that is perpendicular to the shaft line of the second rotational unit 30. For example, in the lighting device 1 illustrated in FIG. 8, that is, in the lighting device 1 at the initial position, the pair of pivotally supporting parts 33 and 34 are disposed on a single straight line (same straight line) along the X axis. Furthermore, in the lighting device 1, the positions of the pivotally supporting parts 33 and 34 on the XZ plane are changed, due to the rotational movement of the first rotational unit 20.

An insertion hole 341 is formed in the center portion of the pivotally supporting part 34. Furthermore, similar to the insertion hole 341 of the pivotally supporting part 34, an insertion hole (not illustrated) is formed in the center portion of the pivotally supporting part 33, and an end of a shaft member 35 is fitted into the insertion hole of the pivotally supporting part 33. Furthermore, similar to the shaft member 35 of the pivotally supporting part 33, an end of a shaft member 35 is fitted into the insertion hole 341 of the pivotally supporting part 34.

The other ends of the shaft members 35 that are fitted into the pivotally supporting part 33 and the pivotally supporting part 34 are inserted into the bearing units 24 and 25, and are supported by the bearing units 24 and 25. For example, the other end of the shaft member 35 that is fitted into the pivotally supporting part 33 is inserted into an insertion hole 241 of the bearing unit 24. Furthermore, for example, the other end of the shaft member 35 that is fitted into the pivotally supporting part 34 is inserted into an insertion hole 251 of the bearing unit 25. In this manner, the first rotational unit 20 rotatably supports the second rotational unit 30 around the shaft line of the pivotally supporting parts 33 and 34, in the vertical direction (perpendicular direction).

As illustrated in FIG. 8, in the plan view of the second rotational unit 30, the shaft line of the pivotally supporting parts 33 and 34 passes through the base unit 31 of the second rotational unit 30 other than the center. More particularly, in FIG. 8, in the plan view of the second rotational unit 30, the shaft line of the pivotally supporting parts 33 and 34 extends in the direction along the X axis, and passes through the position that is shifted (offset) from the center of the base unit 31 of the second rotational unit 30, in the positive Z axis direction. In the following, a direction toward which the negative Z axis direction side of the shaft line of the pivotally supporting parts 33 and 34 of the second rotational unit 30 rotates in the downward direction, is referred to as a plus direction. Furthermore, a direction toward which the positive Z axis direction side of the shaft line of the pivotally supporting parts 33 and 34 of the second rotational unit 30 rotates in the downward direction, is referred to as a minus direction.

The first driving unit 27 that rotatably drives the first rotational unit 20 in the horizontal direction and the second driving unit 32 that rotatably drives the second rotational unit 30 in the vertical direction will now be described.

Figure 9:
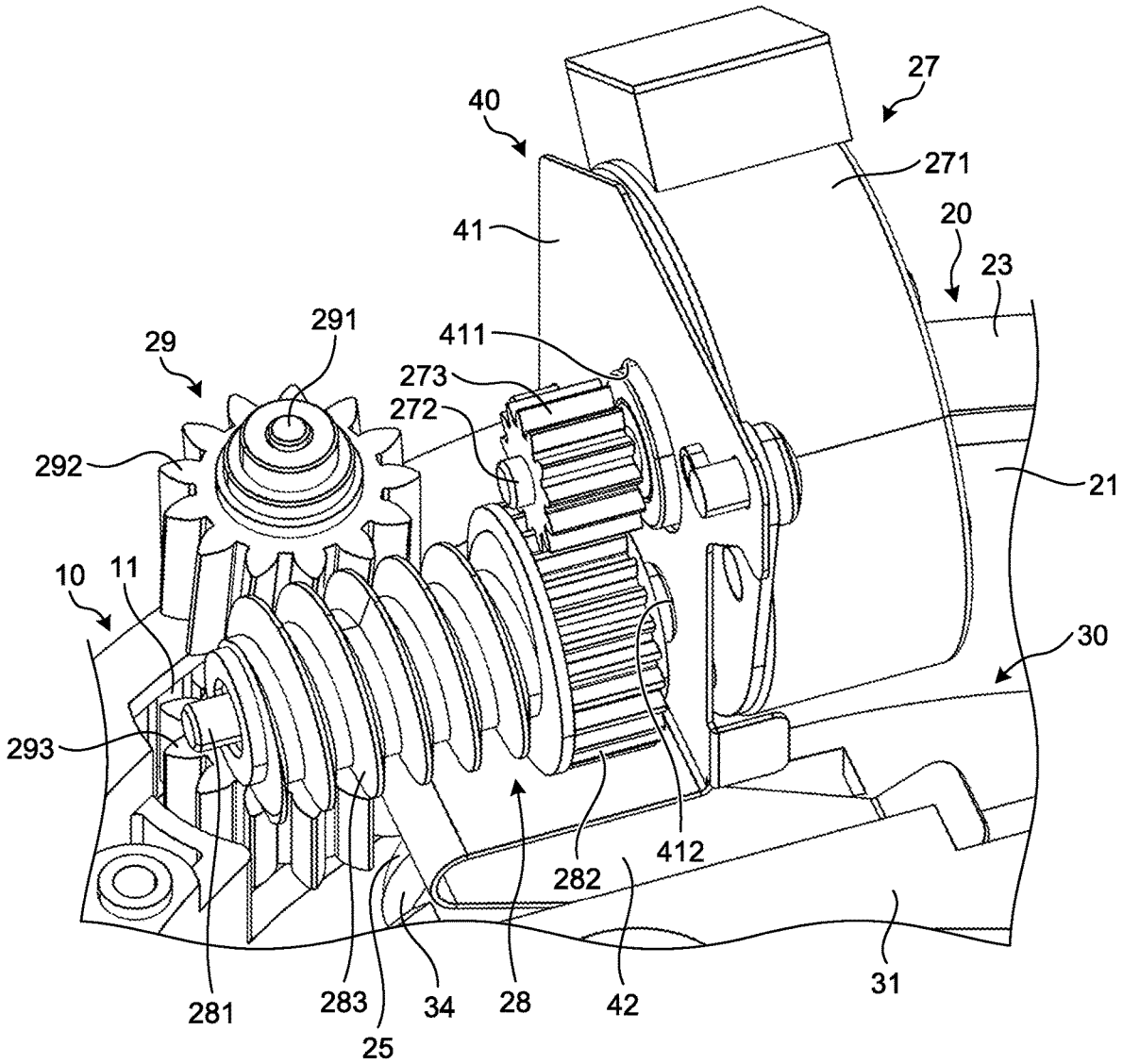
FIG. 9 is a perspective view illustrating a first driving unit according to the embodiment.
Figure 10:
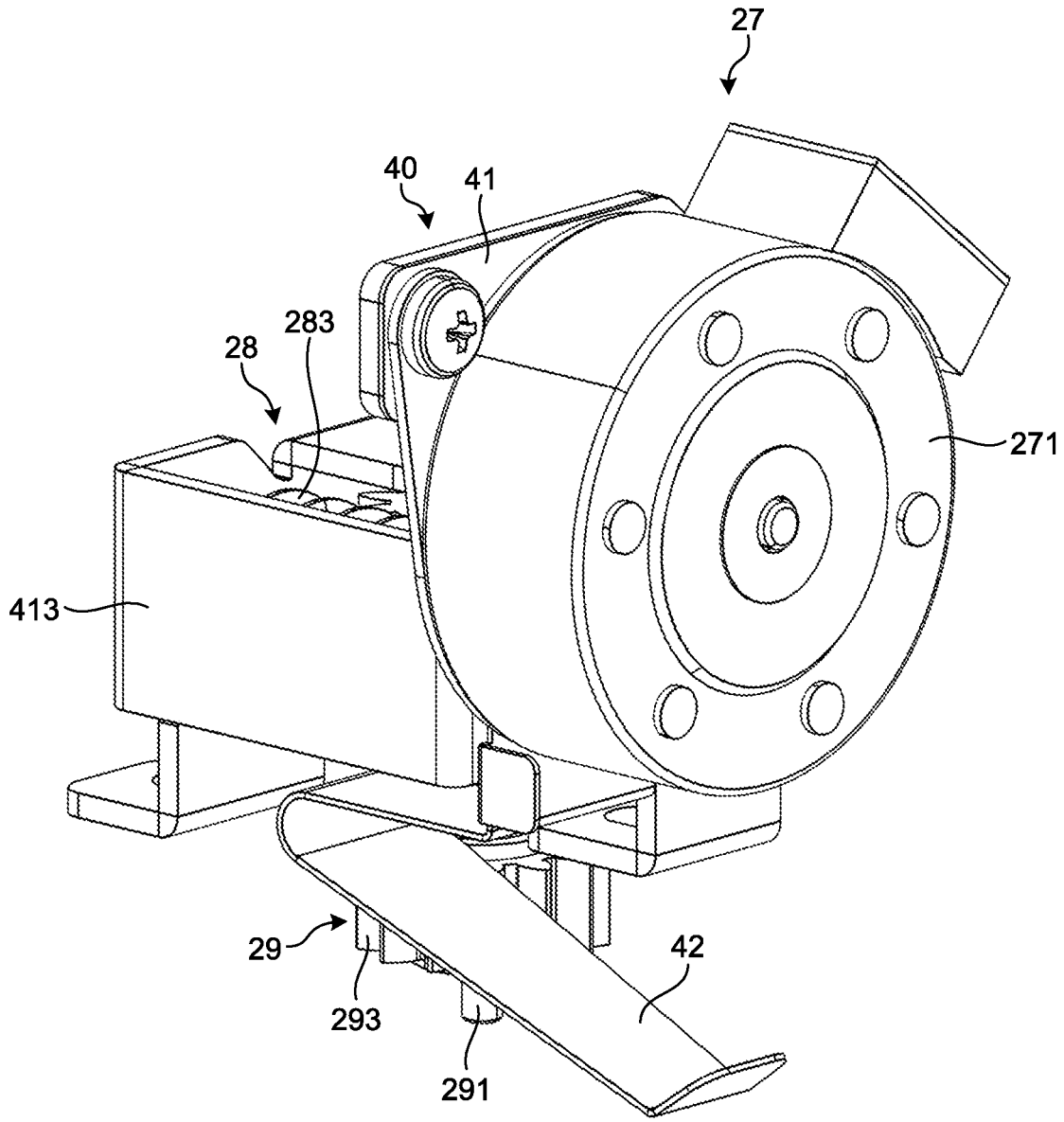
FIG. 10 is a perspective view illustrating the first driving unit according to the embodiment.

As illustrated in FIG. 9 and FIG. 10, the first driving unit 27 includes a first motor 271 serving as a driving source. FIG. 9 and FIG. 10 are perspective views each illustrating a first driving unit according to the embodiment. A gear 273 is mounted on the tip end of an output rotating shaft 272 of the first motor 271. The first motor 271 is fixed to a first bracket unit 41 of the spring member 40 that is fixed to the first rotational unit 20. For example, when the output rotating shaft 272 is inserted into a through hole 411 of the first bracket unit 41, and when the first motor 271 is fixed to the first bracket unit 41 using a fixing mechanism such as a screw, the output rotating shaft 272 is disposed so that the direction of the output rotating shaft 272 is along the opening surface of the frame body 10. For example, the direction of the output rotating shaft 272 of the first motor 271 is the direction perpendicular to the Y axis. For example, a stepping motor is used for the first motor 271, and the first motor 271 is connected to a driving circuit (not illustrated) through a lead wire (not illustrated) extending from the first motor 271.

The gear 273 mounted on the output rotating shaft 272 is meshed with a gear 282 that is mounted on an end of a rotating shaft 281 of a first gear unit 28 at the side where the rotating shaft 281 of the first gear unit 28 is inserted into a through hole 412 of the first bracket unit 41. A worm 283 is mounted on the tip end of the rotating shaft 281 of the first gear unit 28. In other words, the worm 283 is the worm of a worm gear. The worm 283 is a screw-shaped gear has a cylindrical shape.

A shaft conversion unit 29 includes a rotating shaft 291, a worm wheel 292, and a gear 293. The worm wheel 292 of the shaft conversion unit 29 is meshed with the worm 283. In other words, the worm wheel 292 of the shaft conversion unit 29 and the worm 283 form a worm gear. Furthermore, the gear 293 of the shaft conversion unit 29 is meshed with the internal teeth 11 that are formed along the inner periphery of the frame body 10. Consequently, the first rotational unit 20 rotates in the horizontal direction corresponding to the output of the first driving unit 27. Furthermore, although not illustrated in FIG. 9, the spring member 40 includes a wall 413 that surrounds the periphery of the first gear unit 28 and the shaft conversion unit 29 as illustrated in FIG. 10.

The spring member 40 includes an urging unit 42 that is formed as a spring. The urging unit 42 continues to the lower end of the first bracket unit 41. The spring member 40 urges the second rotational unit 30 in the negative Y axis direction through the urging unit 42. More specifically, the urging unit 42 of the spring member 40 urges the positive Z axis direction side of the shaft line of the pivotally supporting parts 33 and 34 of the second rotational unit 30 in FIG. 8, in the downward direction. In other words, the urging unit 42 of the spring member 40 urges the second rotational unit 30 in the minus direction. For example, the urging unit 42 of the spring member 40 may urge the second rotational unit 30 over the entire rotation range in the vertical direction. Furthermore, the spring member 40 rotationally moves in the horizontal direction with the second rotational unit 30. The urging unit 42 of the spring member 40 may also be provided on a second bracket 322 (see FIG. 3), which will be described below. The second bracket 322 may be a spring member.

Figure 11:
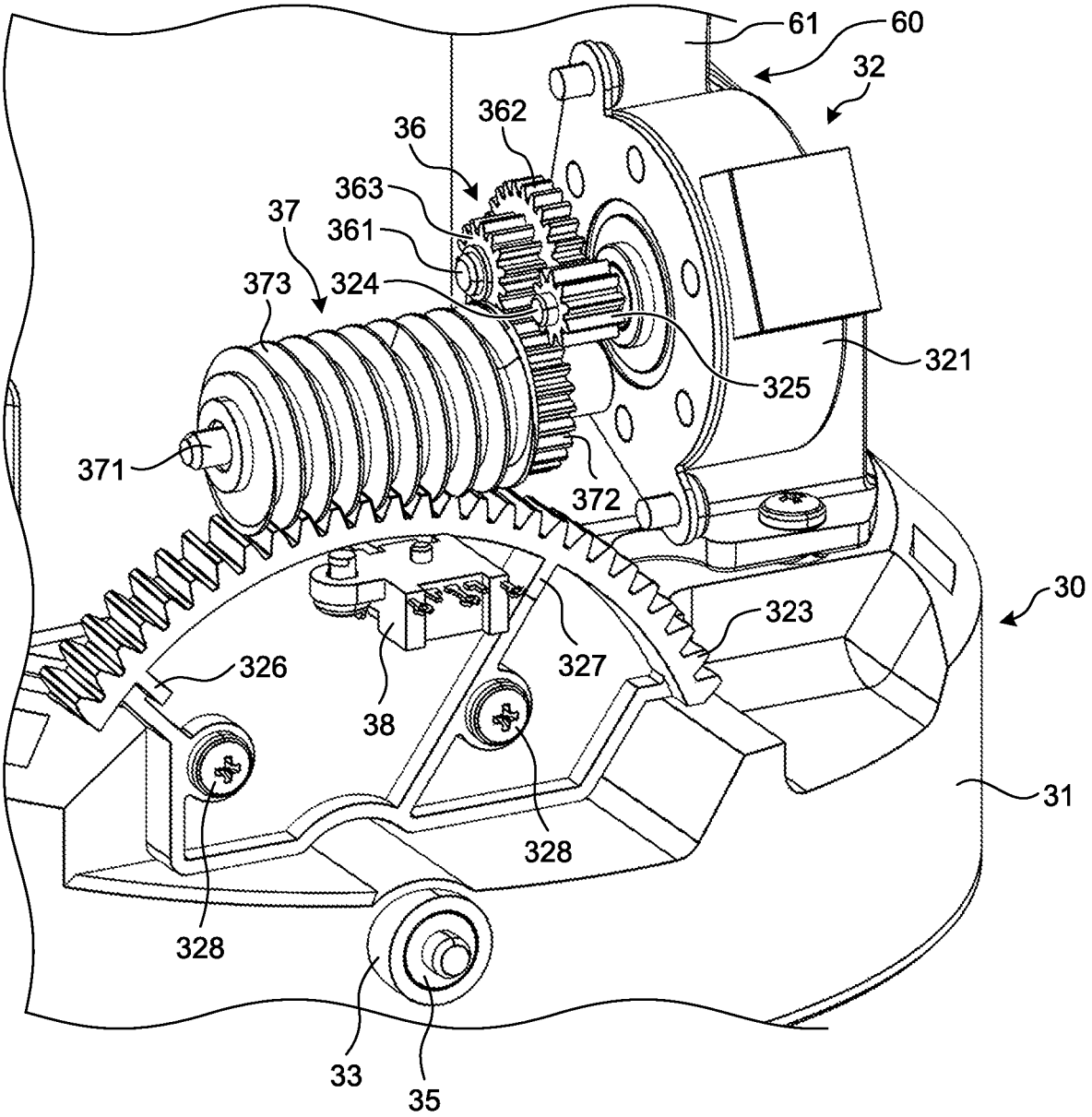
FIG. 11 is a perspective view illustrating a second driving unit according to the embodiment.

Next, the second driving unit 32 that rotationally moves the second rotational unit 30 will be described with reference to FIG. 11. FIG. 11 is a perspective view illustrating a second driving unit according to the embodiment. As illustrated in FIG. 11, the second driving unit 32 includes a second motor 321 serving as a driving source, the second bracket 322 (see FIG. 3), and a fixing gear 323. FIG. 11 illustrates a state excluding the second bracket 322 to describe the configuration of the second driving unit 32. Furthermore, the configuration of the second driving unit 32 illustrated in FIG. 11 indicates a position (state) when the second bracket 322 is holding the second driving unit 32.

A gear 325 is mounted on the tip end of an output rotating shaft 324 of the second motor 321. As illustrated in FIG. 3, the second motor 321 is fixed to the second bracket 322 that is fixed to the first rotational unit 20. For example, when the second motor 321 is fixed to the second bracket 322 using a fixing mechanism such as a screw, the output rotating shaft 324 is disposed so that the direction of the output rotating shaft 324 is along the opening surface of the frame body 10. For example, the direction of the output rotating shaft 324 of the second motor 321 is the direction perpendicular to the Y axis. For example, a stepping motor is used for the second motor 321, and the second motor 321 is connected to a driving circuit (not illustrated) through a lead wire (not illustrated) extending from the second motor 321.

The gear 325 mounted on the output rotating shaft 324 is meshed with a large diameter gear 362 that is mounted on a rotating shaft 361 of a stepped gear unit 36. A small diameter gear 363 is also mounted on the rotating shaft 361 of the stepped gear unit 36. The second bracket 322 rotatably supports the stepped gear unit 36.

A gear 372 mounted on a rotating shaft 371 of a first gear unit 37 is meshed with the small diameter gear 363 of the stepped gear unit 36. Furthermore, a worm 373 is mounted on the tip end of the rotating shaft 371 of the first gear unit 37. In other words, the worm 373 is the worm of a worm gear. The worm 373 is a screw-shaped gear having a cylindrical shape. The second bracket 322 rotatably supports the first gear unit 37.

The fixing gear 323 is meshed with the worm 373 of the first gear unit 37. In other words, the fixing gear 323 and the worm 373 form a worm gear. For example, the fixing gear 323 is fixed to the second rotational unit 30, when a screw member 328 is screwed into the insertion hole 341 (see FIG. 7) of the second rotational unit 30. Consequently, the second rotational unit 30 rotates in the vertical direction, corresponding to the output of the second driving unit 32.

A limit switch 38 is disposed on the second bracket 322. Furthermore, a pair of projection units 326 and 327 are formed on a surface facing the limit switch 38 of the fixing gear 323. Thus, the projection units 326 and 327 restrict the rotation of the second rotational unit 30 in the vertical direction that is caused by the second driving unit 32. A lever (not illustrated) similar to the lever 221 of the limit switch 22 is provided on the limit switch 38. In other words, the angle adjustment device 2 electrically detects the rotating operation of the second rotational unit 30 in the vertical direction, by the limit switch 38 fixed to the second bracket 322 as well as the projection units 326 and 327 of the fixing gear 323.

The angle adjustment device 2 detects the limit of the rotation angle that has been set, when the lever of the limit switch 38 is rotationally moved by one of the projection units 326 and 327 of the fixing gear 323. The limit is used to control the motor, such as to stop operating the second motor 321. In the present embodiment, the limit switch 38 and the projection units 326 and 327 of the fixing gear 323 restrict the rotation angle of the second rotational unit 30 in the vertical direction, to a range from −30 degrees to +45 degrees.

Figure 12:
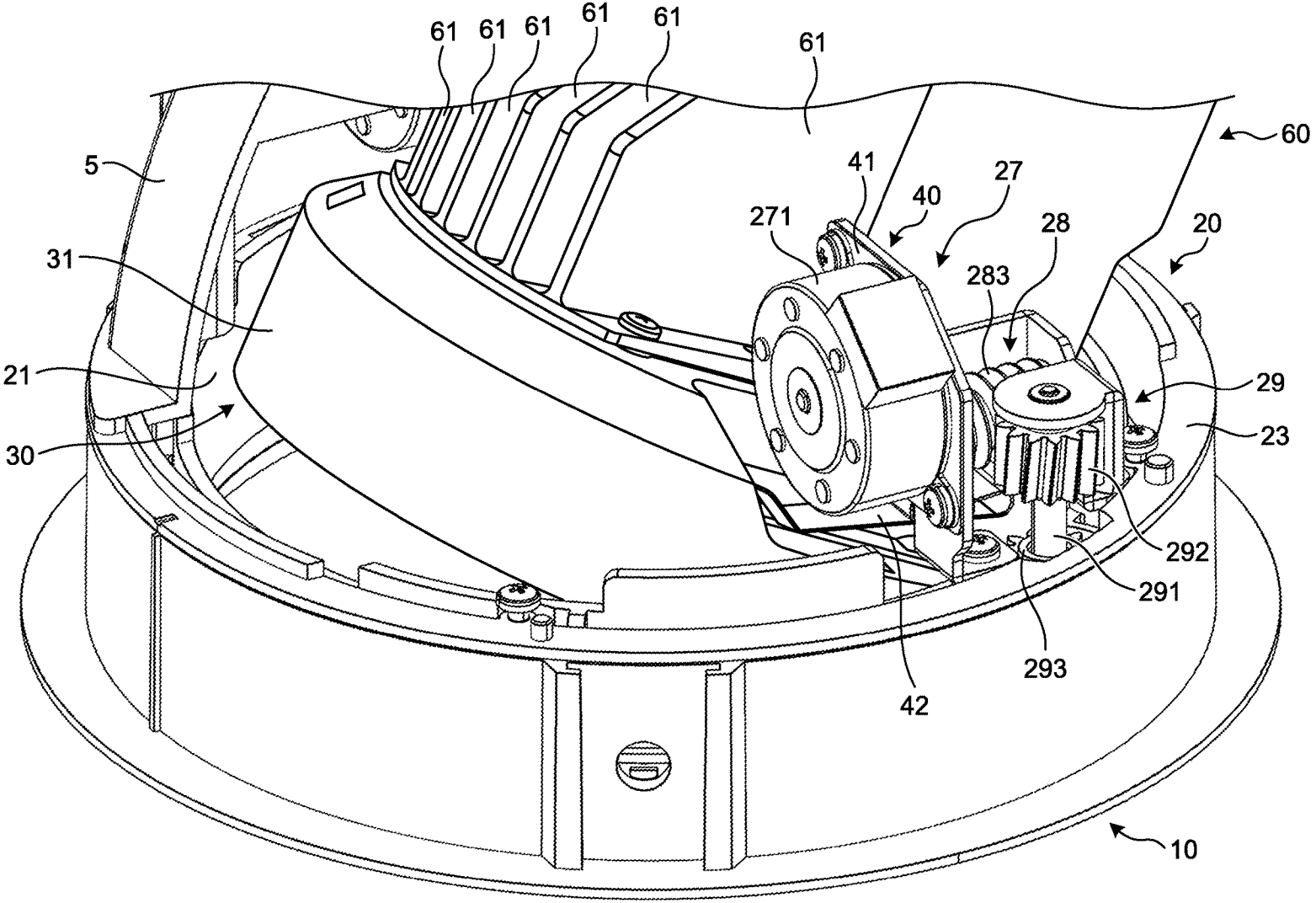
FIG. 12 is a main part perspective view illustrating an inclination of the lighting device according to the embodiment.

For example, FIG. 12 illustrates a state when the second rotational unit 30 is inclined in a direction toward which the negative Z axis direction side of the shaft line of the pivotally supporting parts 33 and 34 (see FIG. 7) of the second rotational unit 30 rotates in the downward direction, that is, when the second rotational unit 30 is inclined in the plus direction. FIG. 12 is a main part perspective view illustrating an inclination of the lighting device according to the embodiment. In this manner, the second rotational unit 30 can rotate to a predetermined angle in both vertical directions.

Figure 13:
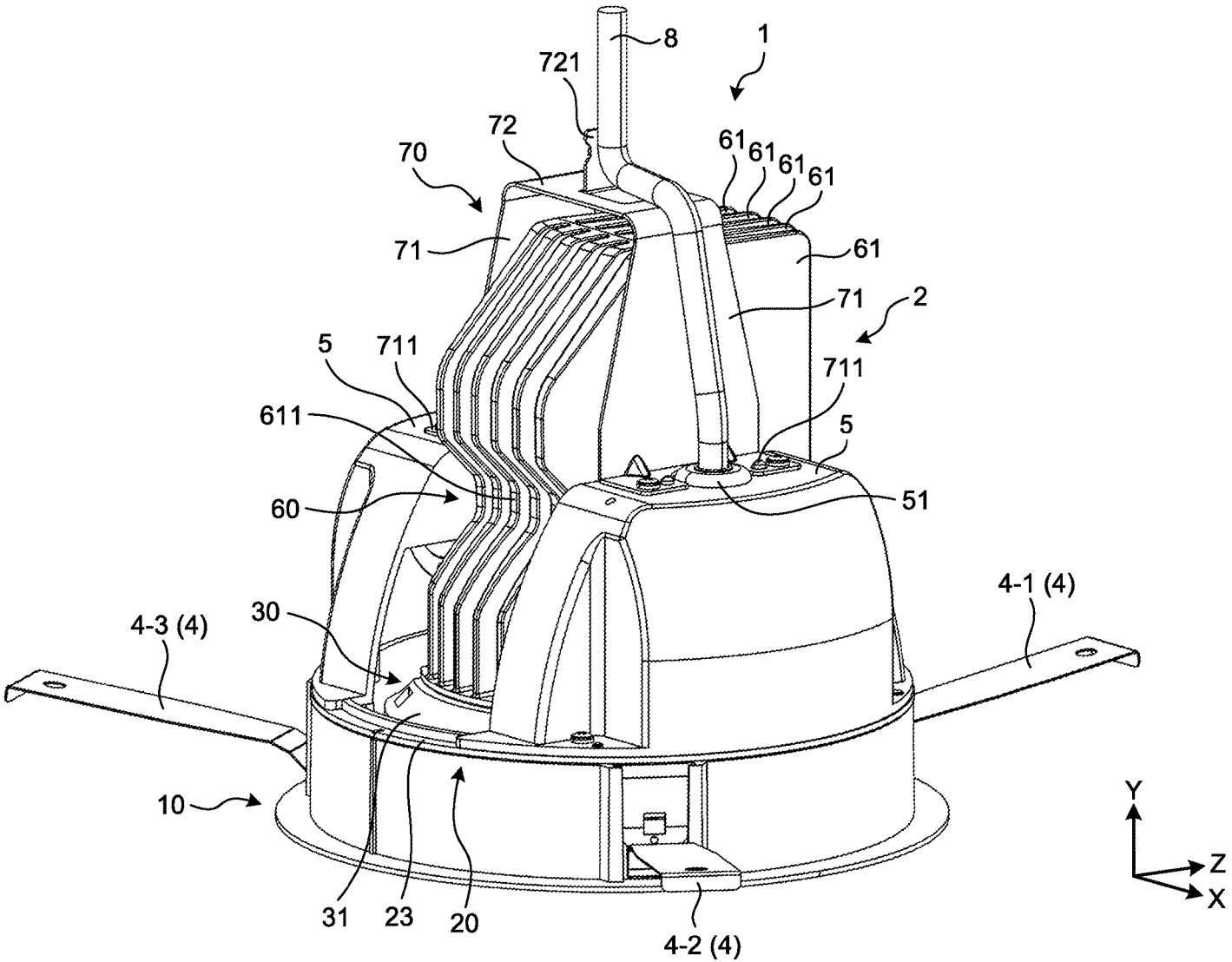
FIG. 13 is a perspective view illustrating the lighting device according to the embodiment.
Figure 14:
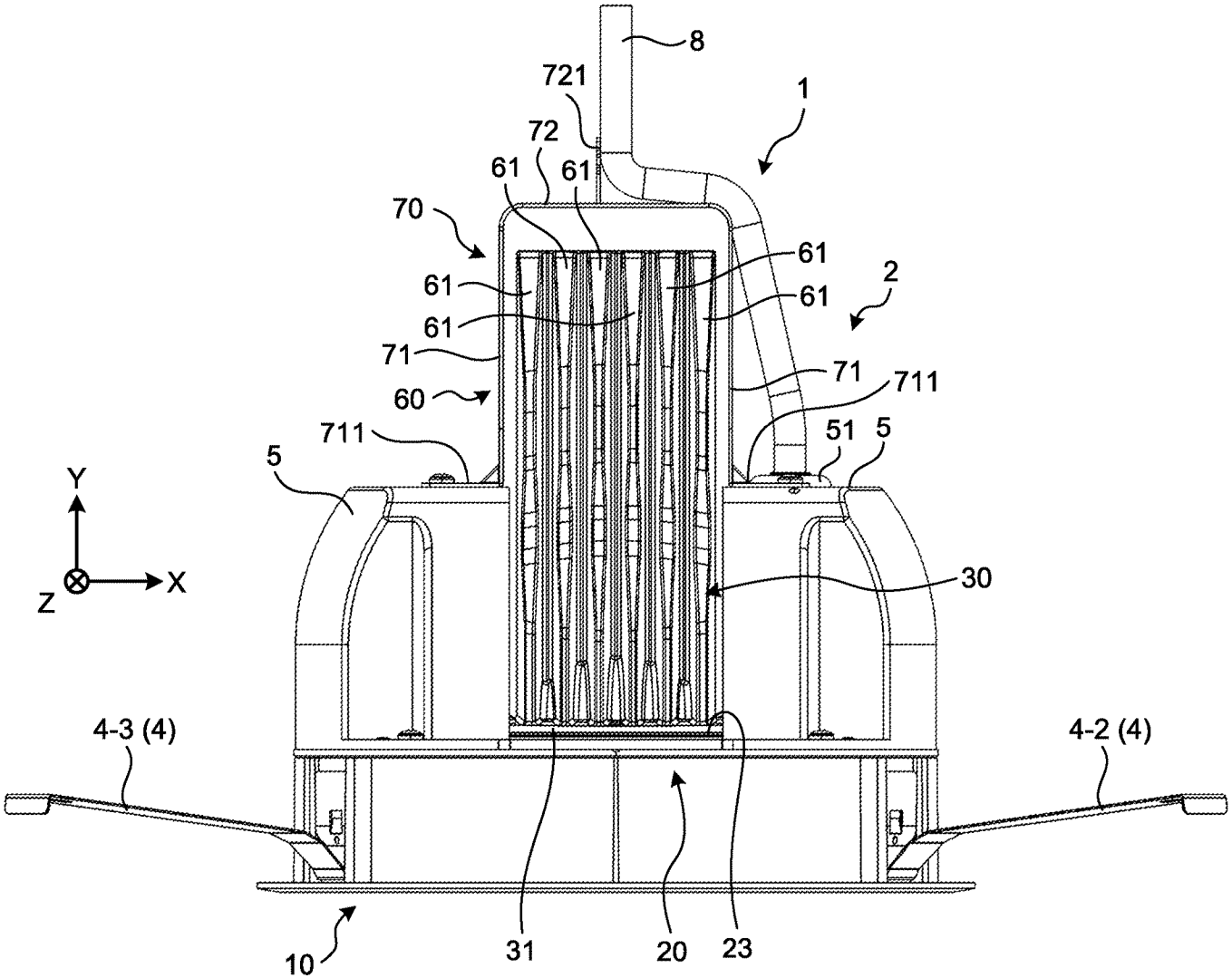
FIG. 14 is a rear view illustrating the lighting device according to the embodiment.

A structure of the other surface 202 side (opening surface side of the outer flange unit 23) of the first rotational unit 20 in the lighting device 1 will now be described with reference to FIG. 13 and FIG. 14. FIG. 13 is a perspective view illustrating the lighting device according to the embodiment. FIG. 14 is a rear view illustrating the lighting device according to the embodiment. For example, as illustrated in FIG. 13, the pair of covers 5, the heat sink 60, and the holding unit 70 are disposed on the other surface 202 side of the first rotational unit 20 in the lighting device 1.

As illustrated in FIG. 13, the heat sink 60 is disposed upright on the other surface 202 side of the first rotational unit 20. More specifically, the heat sink 60 is fixed to the second rotational unit 30 of the angle adjustment device 2, and is projected in the positive Y axis direction. A plurality of heat radiation fins 61 are arranged side by side in the heat sink 60. In FIG. 13, the heat radiation fins 61 are arranged side by side in the X axis direction. Furthermore, as illustrated in FIG. 13, it is possible to rotate the lighting device 1 to a desirable angle, by a notch 611 of each of the heat radiation fins 61, without the rotation of the lighting device 1 in the plus direction being restricted by the heat sink 60.

The pair of covers 5 are overlapped with at least a part of the heat sink 60 on the other surface 202 side of the first rotational unit 20 excluding the upright portion. The pair of covers 5 are provided at positions with the heat sink 60 interposed therebetween, in a direction toward which the heat radiation fins 61 are arranged side by side. In FIG. 13, the pair of covers 5 are provided at positions with the heat sink 60 interposed therebetween, in the X axis direction. Furthermore, an insertion hole 51 is provided on one of the covers 5, and for example, the cable 8 for supplying power to the light source 100 is drawn out from the lighting device 1.

The holding unit 70 is disposed on the other surface 202 side of the first rotational unit 20, and rotationally moves with the first rotational unit 20. For example, the holding unit 70 is formed of a metal material such as aluminum. The holding unit 70 may be formed of any material as long as the holding unit 70 can hold the cable 8 in a desirable direction. Furthermore, the holding unit 70 holds the cable 8 at a position away from the first rotational unit 20 toward the other surface 202 side, while placing the cable 8 along the first rotating shaft. A specific configuration of the holding unit 70 on this point will now be described.

The holding unit 70 includes a pair of upright units 71, a coupling unit 72, and a standing unit 721. The pair of upright units 71 are fixed to the pair of covers 5, respectively, and are disposed upright in a direction away from the other surface 202 of the first rotational unit 20 (positive Y axis direction in FIG. 13). More specifically, the pair of upright units 71 are fixed to the pair of covers 5, respectively, by an extension unit 711 that is provided on an end of each of the pair of upright units 71. For example, the extension unit 711 of the upright unit 71 is fixed to the cover 5 using a screw mechanism and the like.

As illustrated in FIG. 14, the coupling unit 72 continues to the pair of upright units 71. More specifically, both ends of the coupling unit 72 continue to the other ends (ends in the positive Y axis direction side) of the pair of upright units 71, respectively. For example, the coupling unit 72 extends in the horizontal direction (X axis direction in FIG. 14), and continues to each of the other ends of the pair of upright units 71.

As illustrated in FIG. 14, distance between the pair of upright units 71 of the holding unit 70 (X axis direction in FIG. 14) is larger than the width of the heat sink 60. Furthermore, the coupling unit 72 of the holding unit 70 is provided at a position higher than that of the heat sink 60. More specifically, the coupling unit 72 of the holding unit 70 is provided at a position higher than that of the heat sink 60, when the position of the heat sink 60 becomes highest corresponding to the rotational movement of the second rotational unit 30. Furthermore, the holding unit 70 and the heat sink 60 rotationally move with the first rotational unit 20. In this manner, the holding unit 70 is provided at the position free from obstructing the rotational movement of the second rotational unit 30.

Furthermore, the standing unit 721 is a projection that stands along the first rotating shaft and to which the cable 8 is fixed. The standing unit 721 is provided on the center portion of the coupling unit 72. For example, in the holding unit 70, the standing unit 721 causes the cable 8 to stand in a direction away from the other surface 202 side of the first rotational unit 20, at a position where the cable 8 is overlapped with the first rotating shaft. In this manner, the lighting device 1 can prevent the entanglement of a cable due to the rotational movement, by causing the cable 8 to extend along the first rotating shaft at the position where the cable 8 is overlapped with the first rotating shaft.

Figure 15:
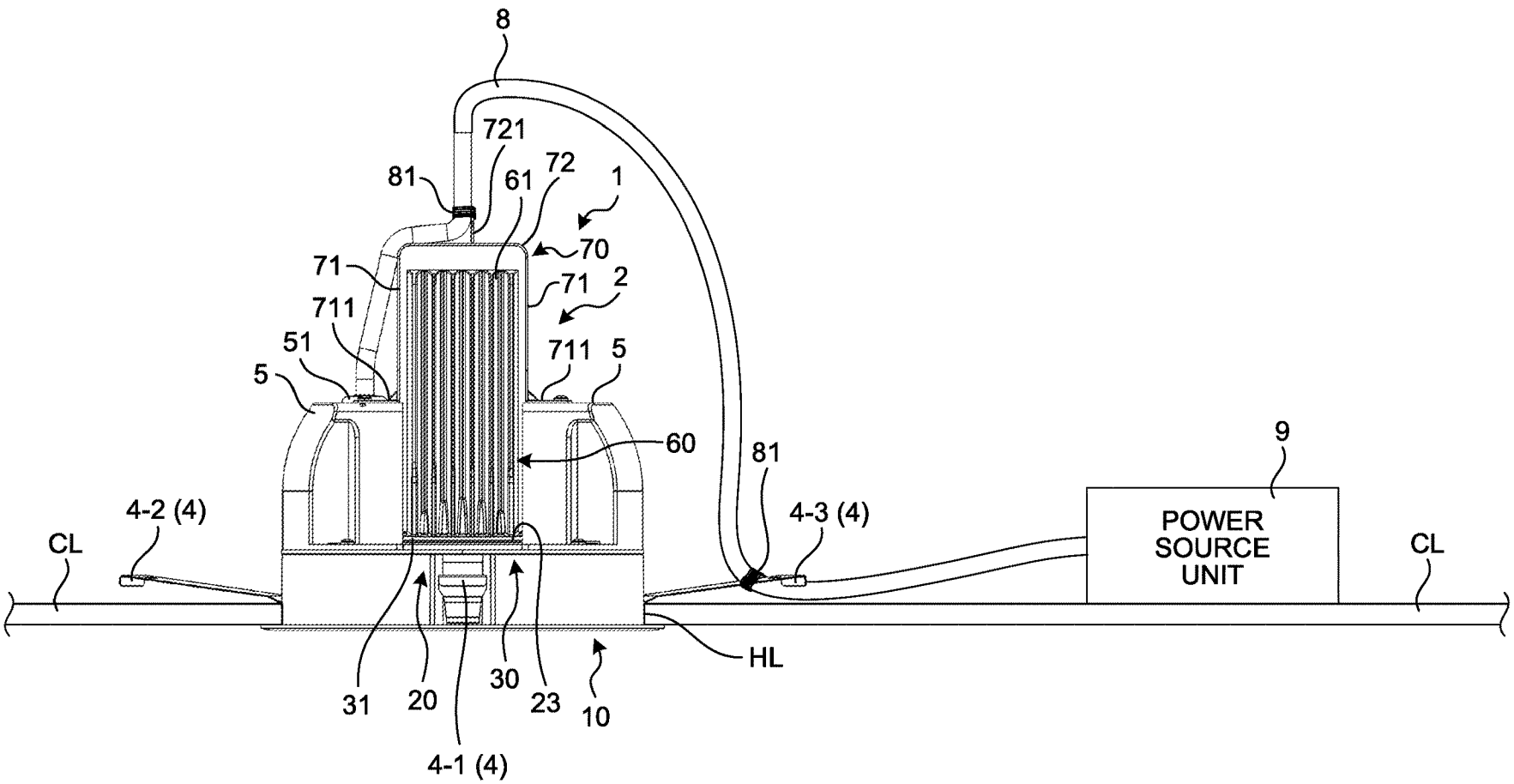
FIG. 15 is a diagram illustrating an installation example of the lighting device according to the embodiment.

A specific installation of the lighting device 1 will now be described with reference to FIG. 15. FIG. 15 is a diagram illustrating an installation example of the lighting device according to the embodiment. As illustrated in FIG. 15, when the frame body 10 is fitted into an embedding hole HL that is provided on the ceiling CL, the lighting device 1 is embedded in the ceiling CL. As illustrated in FIG. 13, the fixtures 4 are fixed on the outer periphery of the frame body 10 at equal intervals in the circumference direction, and the frame body 10 is fixed in the embedding hole HL by the fixtures 4. In other words, the lighting device 1 is installed on the ceiling CL, by being fitted into the embedding hole HL by the fixtures 4 that extend from the outer periphery of the frame body 10 toward the outside.

For example, the fixtures 4 are formed of an elastic material and the like, and an installer of the lighting device 1 inserts the frame body 10 into the embedding hole HL, while pushing and narrowing the fixtures 4 (a state when the fixtures 4 are directed upward in FIG. 15). After the frame body 10 is inserted into the embedding hole HL, and when the fixtures 4 are spread to the original state by the own urging force behind the ceiling CL (upper side of the ceiling CL), the frame body 10 is fitted into the embedding hole HL, and the lighting device 1 is installed on the ceiling CL.

In this example, as illustrated in FIG. 15, the power source unit 9 of the lighting device 1 is also installed behind the ceiling CL (upper side of the ceiling CL). The cable 8 that is drawn out from the lighting device 1 is connected to the power source unit 9. In FIG. 15, the lighting device 1 and the power source unit 9 are disposed side by side behind the ceiling CL (upper side of the ceiling CL) in the horizontal direction. Consequently, the lighting device 1 rotates around the power source unit 9, and distance between the insertion hole 51 of the cover 5 from which the cable 8 is drawn out from the lighting device 1 and the power source unit 9 is varied. In this case, simply holding the cable 8 of the lighting device 1 by the holding unit 70 is insufficient to prevent the entanglement of the cable 8 due to the rotational movement of the lighting device 1. Thus, in the lighting device 1 illustrated in FIG. 15, a fixture 4-3 among the fixtures 4 holds the cable 8 between the holding unit 70 and the power source unit 9. In other words, in the lighting device 1, the cable 8 is held using the fixture 4-3 that is positioned between the insertion hole 51 of the cover 5 from which the cable 8 is drawn out from the lighting device 1 and the power source unit 9. More specifically, in the example illustrated in FIG. 15, the cable 8 is fitted to the standing unit 721 of the holding unit 70 as well as the fixture 4-3, using a fixing member 81. Thus, the standing unit 721 of the holding unit 70 as well as the fixture 4-3 holds the cable 8. Consequently, as illustrated in FIG. 15, even when the lighting device 1 and the power source unit 9 are arranged side by side, it is possible to prevent the entanglement of the cable 8 due to the rotational movement of the lighting device 1.

Figure 16:
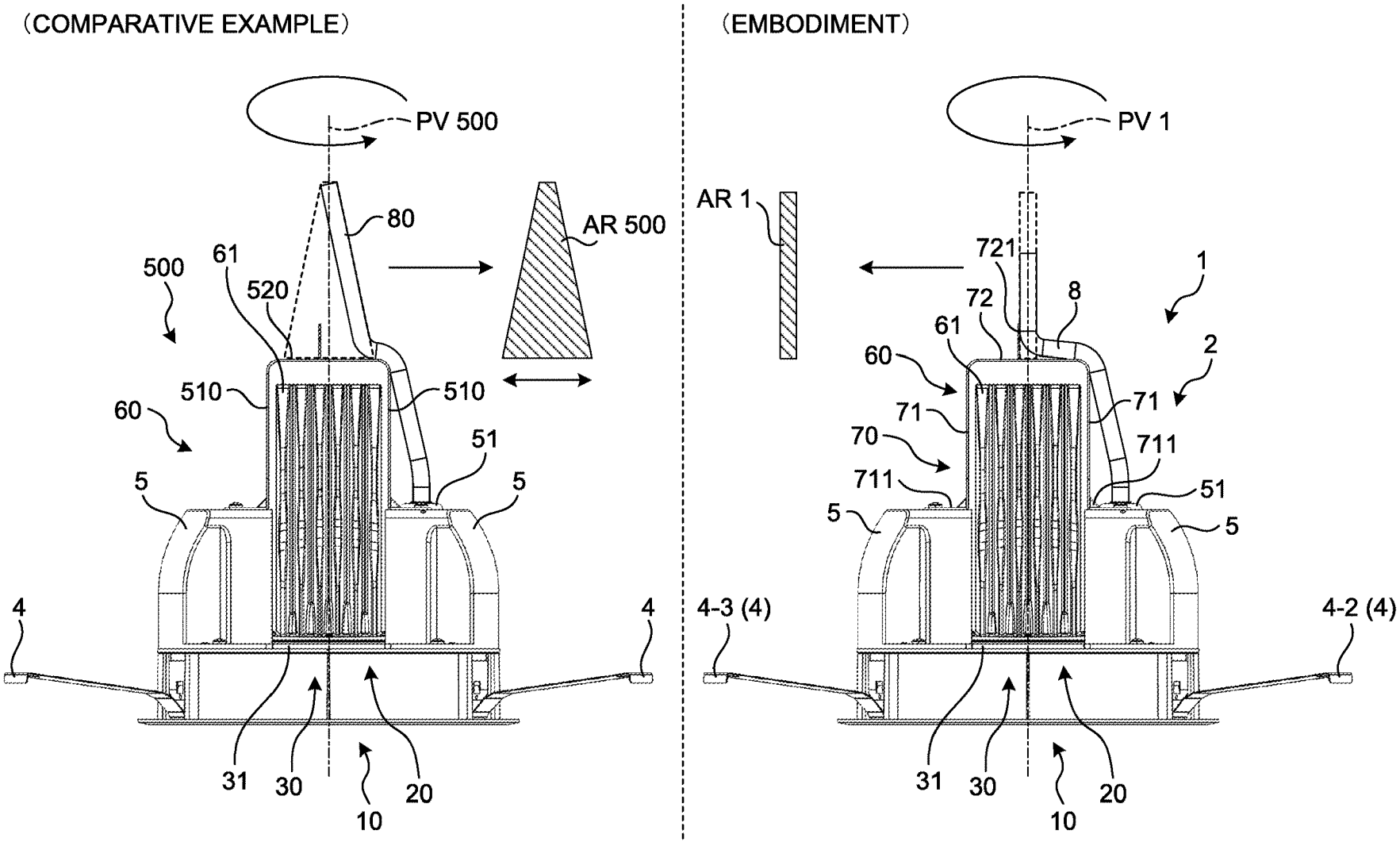
FIG. 16 is a diagram illustrating a comparison of cable displacement due to the rotational movement between a lighting device according to a comparative example and the lighting device according to the embodiment.

Next, displacement of a cable when the lighting device rotationally moves around the first rotating shaft will now be described with reference to FIG. 16. FIG. 16 is a diagram illustrating a comparison of cable displacement due to the rotational movement between a lighting device according to a comparative example and the lighting device according to the embodiment.

A lighting device 500 illustrated in FIG. 16 is a lighting device according to a comparative example. In the example illustrated in FIG. 16, the lighting device 500 includes an upright unit 510 and a coupling unit 520. The lighting device 500 differs from the lighting device 1 in not including a standing unit that causes a cable 80 to stand in a direction away from the other surface 202 of the first rotational unit 20, at the position where the cable 80 is overlapped with a first rotating shaft PV 500. The rest of the lighting device 500 is the same as that of the lighting device 1. Thus, the same reference numerals denote the same components as those of the lighting device 1, and descriptions thereof will be omitted.

Because the lighting device 500 does not include the standing unit that causes the cable 80 to stand in the direction away from the other surface 202 of the first rotational unit 20, at the position where the cable 80 is overlapped with the first rotating shaft PV 500, the cable 80 extends from a portion where one of the upright units 510 and the coupling unit 520 are continued to the portion where the cable 80 is overlapped with the first rotating shaft PV 500, in an oblique direction. Thus, in the lighting device 500, when the lighting device 500 rotationally moves around the first rotating shaft PV 500, the displacement of the cable 80 is increased, as illustrated in the displacement amount AR 500 in FIG. 16.

On the other hand, in the lighting device 1, the lighting device 1 includes the standing unit 721 that causes the cable 8 to stand in the direction away from the other surface 202 of the first rotational unit 20, at the position where the cable 8 is overlapped with the first rotating shaft PV 1. Thus, the cable 8 extends in the direction away from the other surface 202 of the first rotational unit 20, at the position where the cable 8 is overlapped with the first rotating shaft PV 1. Consequently, in the lighting device 1, when the lighting device 1 is rotationally moved around the first rotating shaft PV 1, the displacement of the cable 8 is reduced compared to that of the displacement amount AR 500 of the cable 80 in the lighting device 500, as illustrated in the displacement amount AR 1 in FIG. 16. Hence, in the lighting device 1, the cable 8 integrally rotates (coaxially rotates) with the lighting device 1, thereby suppressing the load applied to the cable 8. Furthermore, because the displacement amount of the cable is reduced due to the coaxial rotation, the lighting device 1 can reduce constraints made on space.

Furthermore, for example, the angle adjustment device 2 remotely operates the first driving unit 27 (first motor 271) and the second driving unit 32 (second motor 321) using wireless communication. For example, the angle adjustment device 2 includes a control unit for wirelessly operating the irradiation direction of the lighting device 1. The control unit includes a transmission unit (remote controller) operated by an operator, a reception unit that is provided on the second rotational unit 30 and that receives control radio waves transmitted from the transmission unit, and a control device that controls the operations of the first motor 271 and the second motor 321, based on the control waves received by the reception unit. A conventional technique is applied to the control unit. Thus, to simplify the description and drawings, the detailed description and drawings of the control unit will be omitted.

For example, the angle adjustment device 2 is set so that the rotation angle (angle displacement amount) of the first rotational unit 20 in the horizontal direction when a single pulse is applied to the first motor 271, and the rotation angle (angle displacement amount) of the second rotational unit 30 in the vertical direction when a single pulse is applied to the second motor 321 are matched or about the same degree. In other words, the gear ratio between the first driving unit 27 and the second driving unit 32 may be determined so that the rotation angle (angle displacement amount) of the first rotational unit 20 in the horizontal direction when a single pulse is applied to the first driving unit 27, and the rotation angle (angle displacement amount) of the second rotational unit 30 in the vertical direction when a single pulse is applied to the second driving unit 32 are matched or about the same degree.

As described above, in the lighting device 1, the first rotational unit 20 rotates in the horizontal direction, and as a result, can rotate the irradiation direction (irradiation shaft) in the horizontal direction while maintaining the inclination angle relative to the vertical line. The rotating operation of the first rotational unit 20 in the horizontal direction by the first driving unit 27, and the rotating operation of the second rotational unit 30 in the vertical direction by the second driving unit 32 have been described separately. However, the control unit can simultaneously control the first driving unit 27 and the second driving unit 32, when an operator performs the operation using a remote controller. In other words, the angle adjustment device 2 can simultaneously perform the rotating operation of the first rotational unit 20 in the horizontal direction and the rotating operation of the second rotational unit 30 in the vertical direction.

In the present embodiment, the angle adjustment device 2 includes the first driving unit 27 for rotatably driving the first rotational unit 20 in the horizontal direction and the second driving unit 32 for rotatably driving the second rotational unit 30 in the vertical direction, which are disposed on the first rotational unit 20. By applying the angle adjustment device 2 such as this, it is possible to reduce the size, especially the whole length, of the lighting device 1. For example, it is possible to provide the lighting device 1 suitable for a ceiling universal downlight to be embedded in a ceiling that has a limited depth. Furthermore, by forming the internal teeth 11 on the inner periphery of the frame body 10, it is possible to reduce not only the size of the angle adjustment device 2 in the horizontal direction, but also the outer diameter of the frame body 10, compared to a case where external teeth are formed on the outer periphery of the frame body 10. Consequently, it is possible to provide the lighting device 1 that can correspond to a smaller embedding hole.

Furthermore, the present invention is not limited to the embodiment described above. The present invention includes those configured by suitably combining the components described above. Furthermore, further advantages and modifications may easily be derived by those skilled in the art. Thus, the broader aspects of the present invention are not limited to the embodiment described above, and various modifications are possible.

For example, the following configuration is possible. By installing a plurality of the lighting devices 1 on the ceiling and connecting the lighting devices 1 using wireless communication, the control unit can simultaneously and remotely operate the lighting devices 1 using a single remote controller. Furthermore, the control unit not only remotely operates the lighting devices 1 through the wireless communication, but may also operate the lighting devices 1 by connecting an operation unit that is to be operated by an operator with the angle adjustment device 2 by wire, for example.

Furthermore, in the embodiment, the lighting device 1 is embedded in a ceiling. However, the present embodiment may also be applied to the lighting device 1 that is connected to an arm or the like, and that is hung down from a ceiling surface or a wall surface; the lighting device 1 that is supported by a base connected to the arm; and the like. The first motor 271 and the second motor 321 are not limited to a stepping motor, and may be a direct current (DC) motor, a DC brushless motor, an alternating current (AC) motor, or the like. In this case also, it is possible to simplify the current control by the control unit, when the rotation angle (angle displacement amount) of the first rotational unit 20 in the horizontal direction, and the rotation angle (angle displacement amount) of the second rotational unit 30 in the vertical direction are matched or about the same.

In the embodiment, the driving force of the driving source is the electric drive unit using a motor. However, the driving force of the driving source may also be a manual drive unit such as a hand of a user and the like. The light source as the object to be operated is not limited to the LED, and for example, may also be another light source such as a krypton bulb. Furthermore, the driving device may be used for changing the direction of any object to be operated, in addition to changing the direction of the light source 100 illustrated in the lighting device 1 according to the embodiment. For example, the object to be operated may be a monitoring camera and the like. In this manner, the object to be operated is optional as long as the direction of the object to be operated is to be changed in a desirable direction, and the driving device can be applied to the object to be operated.

According to an aspect of the present invention, it is possible to prevent entanglement of the cable due to the rotational movement.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A driving device, comprising:

a first rotational unit that is disposed with an object to be operated on one surface side intersecting with a first axis of rotation, the first rotational unit rotationally moving around the first axis of rotation with the object to be operated;

a holding unit that is disposed on another surface side of the first rotational unit, the holding unit rotationally moving with the first rotational unit and holding a cable for supplying power to the object to be operated at a position where the cable is overlapped with the first axis of rotation and away from the first rotational unit toward the other surface side, while placing the cable along the first axis of rotation;

a heat radiation unit that is disposed upright on the other surface side of the first rotational unit; and a cover unit that is overlapped with at least a part of the heat radiation unit at the other surface side of the first rotational unit excluding an upright portion of the heat radiation unit, wherein the heat radiation unit is a heat sink on which a plurality of heat radiation fins are arranged side by side, the cover unit is a pair of covers that are provided at positions with the heat radiation unit interposed therebetween in a direction toward which the heat radiation fins are arranged side by side, and the holding unit includes a standing unit that causes the cable to stand in a direction away from the other surface side of the first rotational unit, at a position in which the cable is overlapped with the first axis of rotation, a pair of upright units that are fixed to the pair of covers, respectively, and a coupling unit that continues to the pair of upright units and that is provided across the heat radiation unit.

2. The driving device according to claim 1, wherein the standing unit is a projection that stands along the first axis of rotation, and the cable is fixed to the projection.

3. The driving device according to claim 1, wherein the standing unit is provided on a center portion of the coupling unit.

4. The driving device according to claim 1, further comprising:

a plurality of fixtures that extend from an outer periphery of a frame body for supporting the first rotational unit toward outside, wherein one of the fixtures holds the cable between the holding unit and a power source unit to which the cable is connected.

5. The driving device according to claim 1, further comprising:

a second rotational unit that is supported by the first rotational unit, the second rotational unit rotationally moving around a second axis of rotation different from the first axis of rotation.

6. The driving device according to claim 5, wherein the holding unit is provided at a position free from obstructing a rotational movement of the second rotational unit.

7. A lighting device, comprising:

the driving device according to claim 1 that includes a light source as the object to be operated.

* * * * *